US008177584B2

(12) United States Patent
Matsuoka

(10) Patent No.: US 8,177,584 B2
(45) Date of Patent: May 15, 2012

(54) CONNECTOR WITH WIRE SEALING RESILIENT PLUG

(75) Inventor: Hiroyuki Matsuoka, Yokkaichi (JP)

(73) Assignee: Sumitomo Wiring Sytems, Ltd. (JP)

( * ) Notice: Subject to any disclaimer, the term of this patent is extended or adjusted under 35 U.S.C. 154(b) by 116 days.

(21) Appl. No.: 12/754,432

(22) Filed: Apr. 5, 2010

(65) Prior Publication Data

US 2010/0261364 A1 Oct. 14, 2010

(30) Foreign Application Priority Data

Apr. 9, 2009 (JP) ..... 2009-095149

(51) Int. Cl.
*H01R 12/40* (2006.01)

(52) U.S. Cl. ..... 439/587

(58) Field of Classification Search ..... 439/589, 439/587, 274, 275

See application file for complete search history.

(56) References Cited

U.S. PATENT DOCUMENTS

| | | | | |
|---|---|---|---|---|
| 2,454,838 | A * | 11/1948 | Kaplan et al. | 439/454 |
| 2,759,989 | A * | 8/1956 | Anderson | 174/397 |
| 4,722,696 | A * | 2/1988 | Ballhause | 439/275 |
| 4,776,813 | A * | 10/1988 | Wilson et al. | 439/587 |
| 5,266,045 | A * | 11/1993 | Yamamoto et al. | 439/275 |
| 6,814,617 | B2 * | 11/2004 | Oota et al. | 439/589 |
| 7,059,918 | B2 * | 6/2006 | Matsumoto et al. | 439/752 |
| 7,094,098 | B2 * | 8/2006 | Miyazaki | 439/559 |
| 7,351,102 | B2 * | 4/2008 | Cykon et al. | 439/587 |
| 7,507,118 | B2 * | 3/2009 | Azuma et al. | 439/587 |
| 7,553,186 | B2 * | 6/2009 | Morikawa et al. | 439/587 |
| 7,614,910 | B2 * | 11/2009 | Croteau et al. | 439/573 |
| 7,811,116 | B2 * | 10/2010 | Sakakura et al. | 439/364 |
| 2010/0159743 | A1 * | 6/2010 | Kato et al. | 439/587 |
| 2010/0255728 | A1 * | 10/2010 | Matsuoka et al. | 439/607.55 |
| 2010/0261364 | A1 * | 10/2010 | Matsuoka | 439/271 |

FOREIGN PATENT DOCUMENTS

JP 2002-281654 9/2002

* cited by examiner

*Primary Examiner* — Neil Abrams

(74) *Attorney, Agent, or Firm* — Gerald E. Hespos; Michael J. Porco

(57) ABSTRACT

A waterproof connector has a housing (21) with cavities (22) for accommodating terminal fittings (40). A wire insertion tube (24) is integral to the housing (21) and receives wires (41) connected with the terminal fittings (40). Rubber plugs (42) are mounted on the wires (41) for liquid-tight sealing between the outer circumferential surfaces of the wires (41) and the inner circumferential surface of the wire insertion tube (24). A back retainer (50) retains the rubber plugs (42) in the wire insertion tube (24). Engaging projections (54) project out from the back retainer (50) and engaging recesses (30) are formed in the wire insertion tube (24) to engage the engaging projections (54). Rounded edges (32) are formed at the inner circumferential surface of the wire insertion tube (24) along opening edges (31A) of the engaging recess (30) extending in a direction intersecting with a longitudinal direction of the wire insertion tube (24).

8 Claims, 6 Drawing Sheets

CONNECTOR WITH WIRE SEALING RESILIENT PLUG

BACKGROUND OF THE INVENTION

1. Field of the Invention

The invention relates to a fluid- or waterproof connector and to an assembling method therefor.

2. Description of the Related Art

Japanese Unexamined Patent Publication No. 2002-281654 discloses a waterproof connector for supplying power to a device, such as a motor accommodated in a metallic case, for example, in an electric car.

The waterproof connector has a synthetic resin housing with opposite front and rear ends and three cavities that penetrate the housing in forward and backward directions. Wire insertion tubes are defined at the rear ends of the respective cavities. The connector also has terminal fittings that can be mounted into the cavities from behind. Each terminal fitting has opposite front and rear ends. A plate-like connecting portion is formed at the front end of each terminal fitting and a wire crimping portion at the rear end. The crimping portions are configured to be crimped into connection with ends of wires.

Rubber plugs are mounted on the respective wires beforehand and are fit into the wire insertion tubes as the terminal fittings are inserted into the cavities to achieve liquid-tight sealing between the inner circumferential surface of the wire insertion tube and the outer circumferential surfaces of the wires. Each rubber plug is a substantially cylindrical tube with annular lips formed on the inner and outer circumferential surfaces. The lips closely contact the outer circumferential surface of the wire and the inner circumferential surface of the housing to seal the entire circumference.

A synthetic resin back retainer is mounted to the rear end portion of the housing from behind for collectively retaining the rubber plugs. The back retainer has two legs divided in a width direction and coupled by a hinge so that both legs are rotatable about the hinge. Each leg has three substantially semicircular recesses, and the wires are held between corresponding upper and lower recesses with the legs closed. Engaging projections are provided on the upper and lower outer surfaces of the legs and engage with engaging recesses near the rear end of the housing. Hence, the back retainer is fixed to the housing and prevents the rubber plugs from coming out of the housing. Opening edges of the engaging recesses are sharp and portions of the engaging recesses extending transverse to the wire insertion tube may damage the rubber plugs and reduce the waterproof property of the rubber plugs when the rubber plugs are fit into the housing.

The invention was developed in view of the above situation and an object thereof is to prevent damage of a resilient plug when the resilient plug is fitted into a connector housing of a fluidproof connector.

SUMMARY OF THE INVENTION

The invention relates to a fluidproof connector with a housing formed with at least one cavity for accommodating at least one terminal fitting. A wire insertion tube is integral or unitary with the housing and can receive at least one wire connected with the terminal fitting. At least one resilient plug is mounted on the wire for fluid-tight sealing between the outer circumferential surface of the wire and the inner circumferential surface of the wire insertion tube. A plug retainer is mounted into the wire insertion tube at an end of the resilient plug substantially opposite to the cavity. At least one engaging projection projects from the outer circumferential surface of the plug retainer, and at least one engaging recess is formed in the wire insertion tube for engaging the engaging projection and retaining the plug retainer. At least an opening edge of the engaging recess extending transverse to the wire insertion tube is beveled. Accordingly, the resilient plug will not get caught by the opening edge of the engaging recess and be damaged when the resilient plug is inserted into the housing.

The engaging recess preferably is a substantially rectangular hole that penetrates the wire insertion tube. Two facing opening edges of the rectangular hole are orthogonal to the longitudinal direction of the wire insertion tube portion.

The engaging recess preferably has two opposed opening edges that are orthogonal to the longitudinal direction of the wire insertion tube. The bevel preferably is formed only at the opening edge closer to the cavity and the opposed opening edge is aligned at a substantially right-angle to the longitudinal direction. Thus, the bevel is formed only on the opening edge that the resilient plug contacts during insertion. The opening edge opposed to the bevel is at a substantially right angle to the longitudinal direction. Thus, the back retainer is held with a high retaining force and the resilient plug is not likely to be damaged during insertion.

At least one guide groove is formed between the engaging recess and the rear opening edge of the wire insertion tube. The guide groove has a dimension corresponding to the width of the bevel. Thus, the resilient plug can be guided along the guide groove and inserted beyond the bevel so that the resilient plug is inserted easily. Further, a pin of a forming die for forming the bevel can be inserted using the guide groove, so that the bevel can be rationally formed.

The bevel may be in the form of a cylindrical surface.

The bevel may be provided on at least one cavity-side opening edge of the engaging recesses.

The plug retainer may have two legs that are laterally adjacent in a width direction and coupled by at least one hinge. Thus, the two legs are rotatable about the hinge.

Each leg may have one or more recesses, and the wires are held between corresponding first and second recesses with the legs closed.

One or more engaging projections may be provided on the legs and can be engaged with respective engaging recesses formed in the housing to fix the plug retainer to the housing.

The resilient plug is not likely to be damaged during insertion to provide a connector with a high waterproof property.

These and other features of the invention will become more apparent upon reading the following detailed description of preferred embodiments and accompanying drawings. Even though embodiments are described separately, single features may be combined to additional embodiments.

DETAILED DESCRIPTION OF THE PREFERRED EMBODIMENTS

Figure 1:
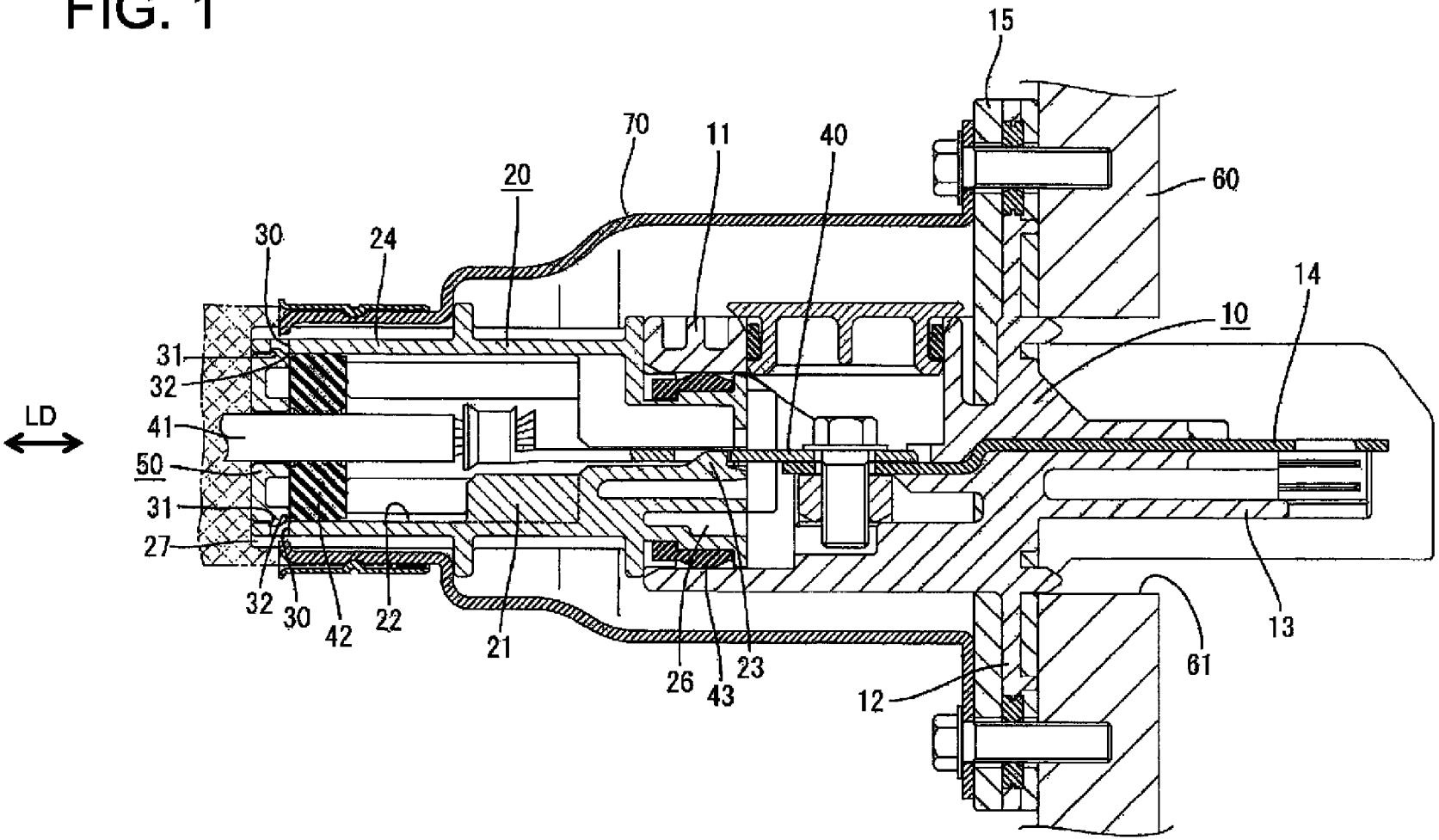
FIG. 1 is a side view in section showing a connected state of two connectors according to one embodiment.

A connector assembly in accordance with the invention has a device-side connector 10 and a fluidproof or waterproof harness-side connector 20 that are connectable with and separable from each other. Ends of the connectors 10, 20 that are to be connected are referred to as front ends, and upper and lower sides of FIG. 1 are referred to respectively as upper and lower sides of the connectors 10, 20. The connector assembly is used for supplying power to an unillustrated device (e.g. motor or inverter installed in a hybrid car). The device is to be accommodated in a conductive metallic case 60 having a shielding function. A mount hole 61 penetrates between outer and inner sides of the case 60.

The device-side connector 10 is to be fixed at the mount hole 61 in the case 60. A device-side connector housing is made e.g. of synthetic resin and includes a receptacle 11 substantially in the form of a wide rectangular parallelepiped. A substantially plate-like flange 12 bulges out over substantially the entire periphery near the rear end of the receptacle 11 and a device-side connecting portion 13 projects back from the rear surface of the flange 12.

Three intermediate terminals 14 are to be held in the device-side connector 10, and a connector mounting member 15 is to be mounted on the flange 12.

The harness-side connector 20 has a housing 21 and three side by side cavities 22 are formed in the housing 21. Terminal fittings 40 fixed to ends of wires 41 are inserted into the cavities 22 from behind and a locking lance 23 near a front end of each cavity 22 engages and retains the terminal fitting 40. A wire insertion tube 24 is located behind the cavities 22 and an unillustrated front stop is provided in the wire insertion tube 24 for contacting the front surfaces of resilient rubber plugs 42 mounted on the wires 41. A back retainer 50 is mounted behind the rubber plugs 42 that have the wires 41 inserted therethrough. The back retainer 50 collectively retains the rubber plugs 42 in the wire insertion tubes 24.

Each plug 42 is formed of a resilient material such as rubber to define a tube through which the wire 41 is insertable. Lips are formed on the inner and outer circumferential surfaces of each plug to be held in close contact with the outer circumferential surface of the wire 41 and the inner surface of the cavity 22 to define a fluid- or liquid-tight sealed over the entire circumference.

Figure 2:
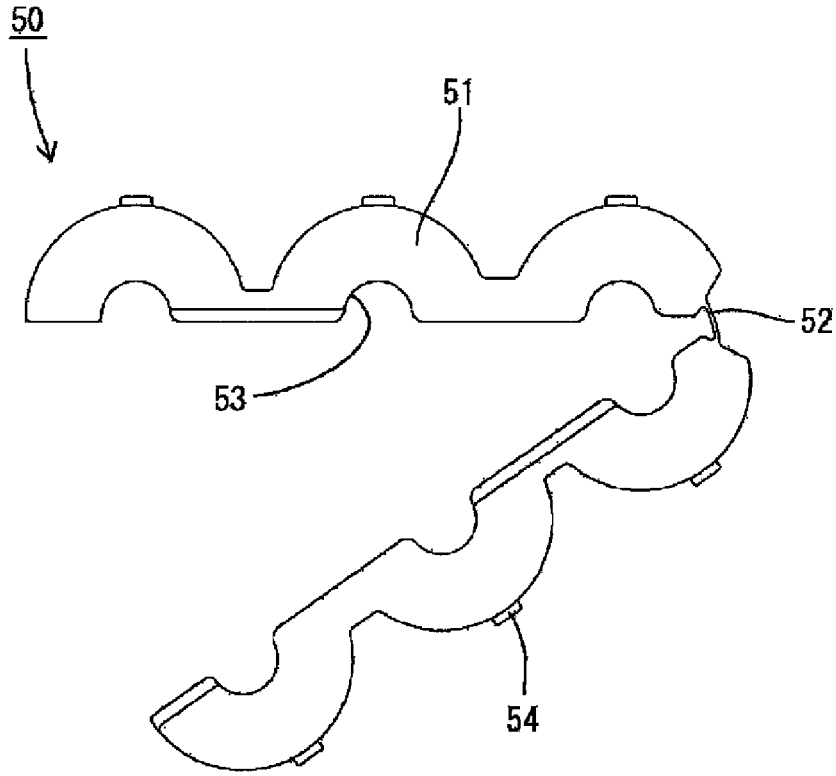
FIG. 2 is a front view showing a state where both leg portions of a back retainer are opened.
Figure 3:
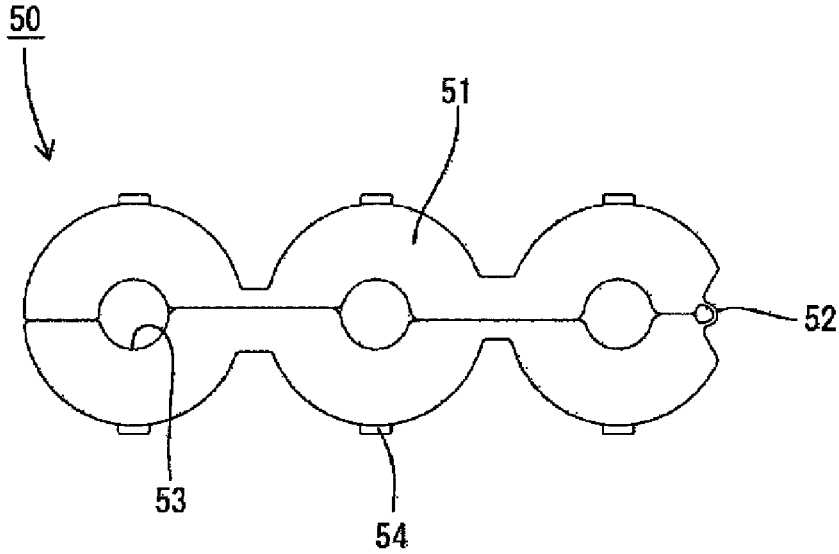
FIG. 3 is a front view showing a state where the both leg portions of the back retainer are closed.

The back retainer 50 is made e.g. of synthetic resin and has first and second legs 51 coupled by a hinge 52. Thus, the legs 51 are rotatable about the hinge 52, as shown in FIG. 2. Each leg 51 has three substantially semicircular recesses 53, and the wires 41 are held between corresponding first and second recesses 53 of FIG. 3 when the legs 51 are closed. As shown in FIGS. 2 and 3, engaging projections 54 are provided on the upper and lower outer surfaces of the legs 51. The engaging projections 54 engage with engaging recesses 30 in a rear end of the housing 21 to fix the back retainer 50 to the housing 21.

Each engaging recess 30 of the housing 21 has two facing opening edges 31 orthogonal to a longitudinal direction LD of the wire insertion tube 24, a cavity-side opening edge 31A is formed with a bevel 32. A guide groove 33 having a dimension corresponding to the width of the bevel 32 is formed between the other opening edge 31B facing the opening edge 31A from the rear side and a leading-end opening edge 27 of the wire insertion tube 24.

A wire-side receptacle 26 is defined at a front end portion of the housing 21 and can fit into the receptacle 11 of the device-side connector 10. A seal ring 43 is mounted on a front part of the outer surface of the wire-side receptacle 26 and is held in close contact with the inner surface of the receptacle 11 when the wire-side receptacle 26 is fit into the receptacle 11. Thus, the seal ring 43 provides sealing between the wire-side receptacle 26 and the receptacle 11 and prevents water from entering the receptacle 11.

A shield shell 70 is mounted on the housing 21 from behind.

Figure 4:
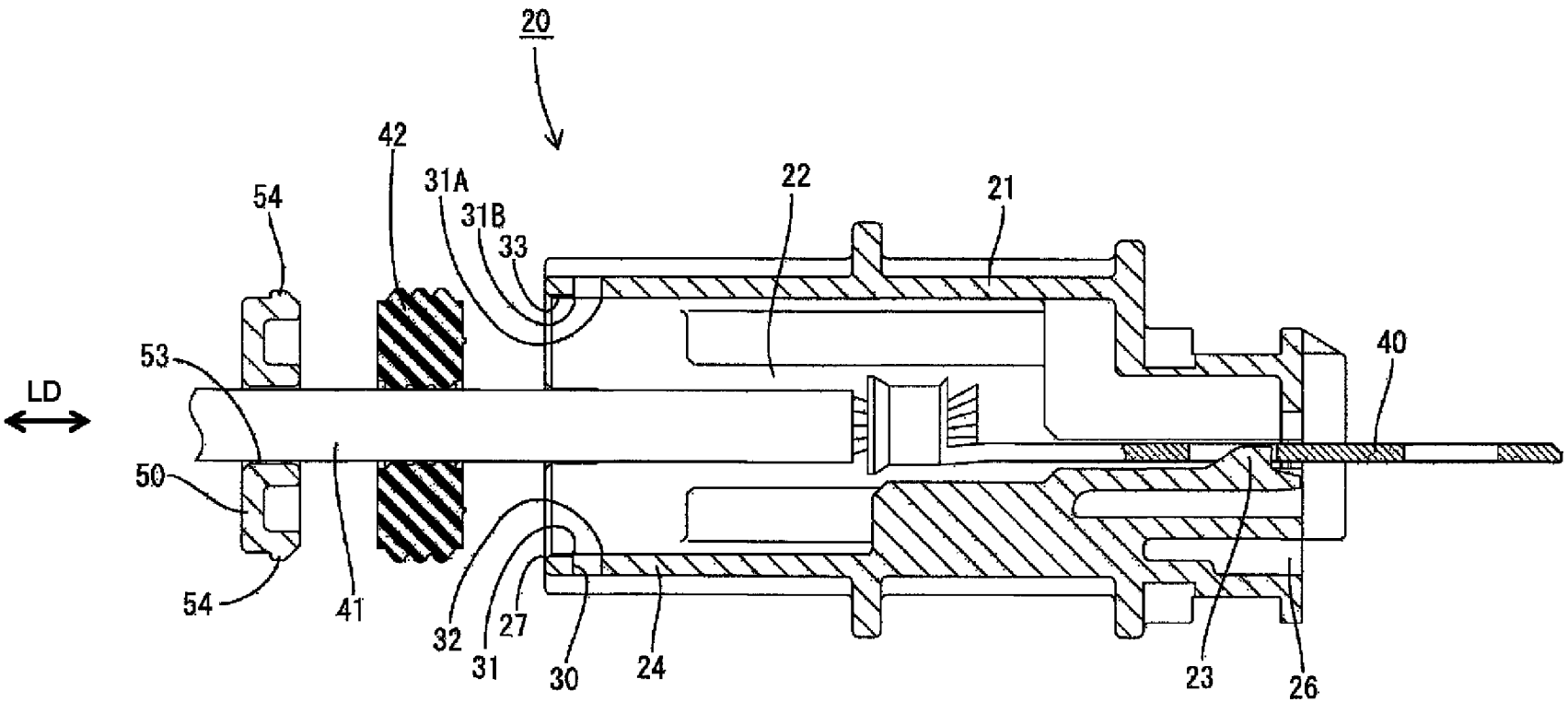
FIG. 4 is a side view in section of a waterproof connector showing a state immediately before the rubber plug and the back retainer are mounted.
Figure 5:
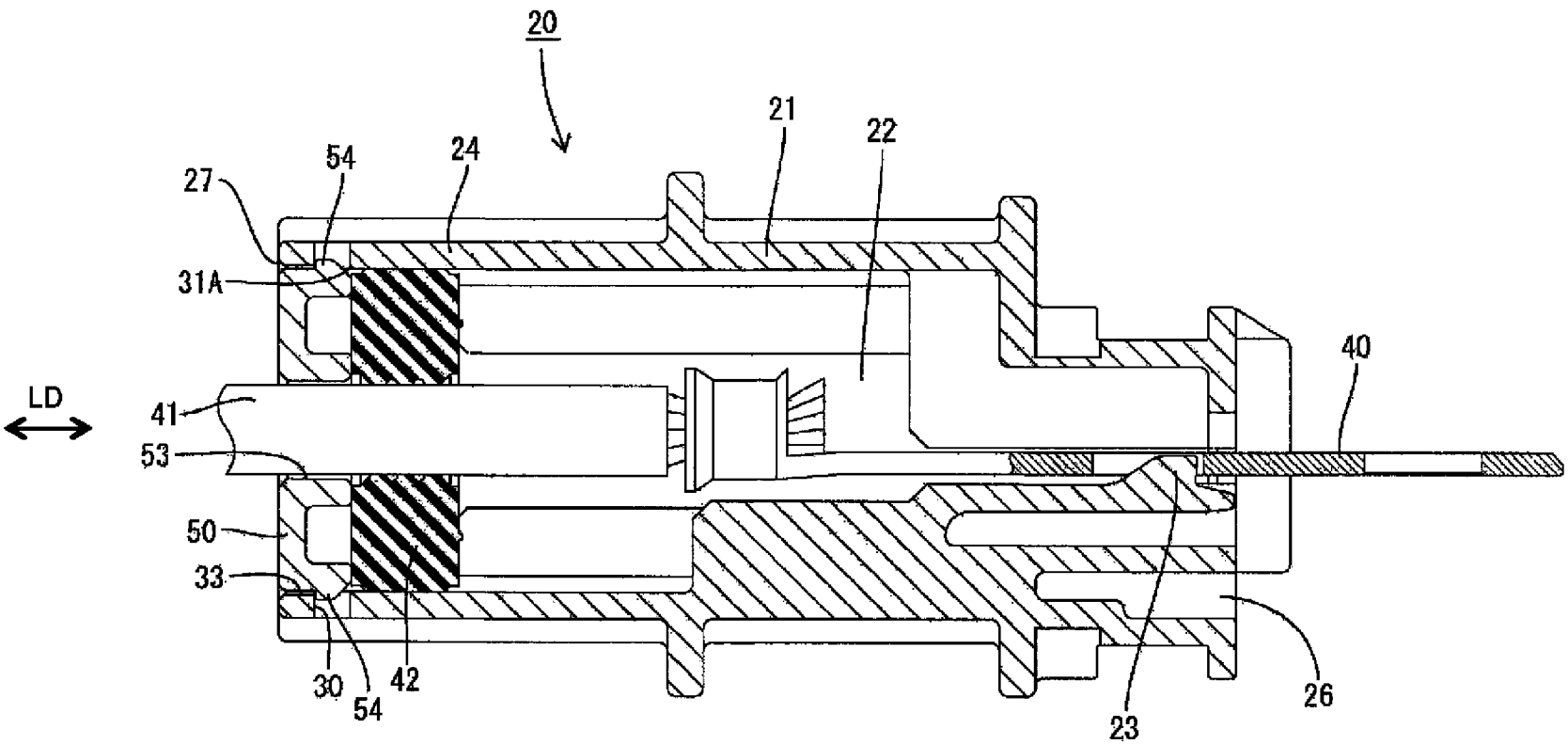
FIG. 5 is a side view in section of the waterproof connector showing a state where the rubber plug and the back retainer are mounted.
Figure 6:
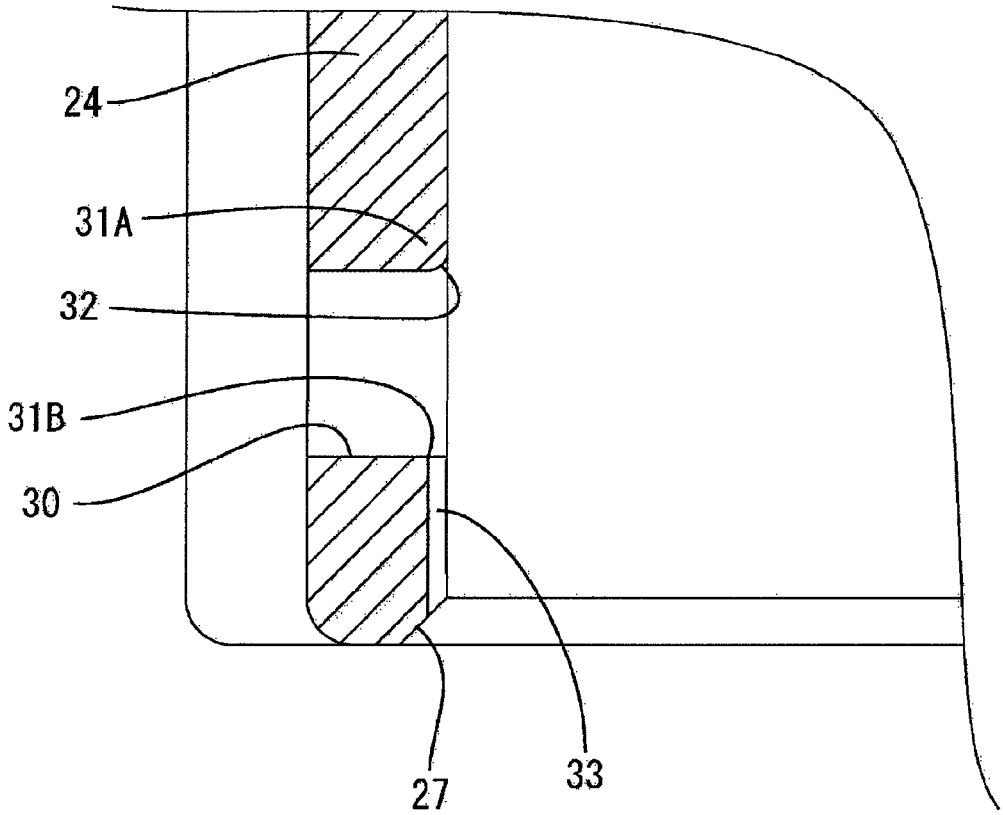
FIG. 6 is an enlarged view of an engaging recess of FIG. 4.
Figure 7:
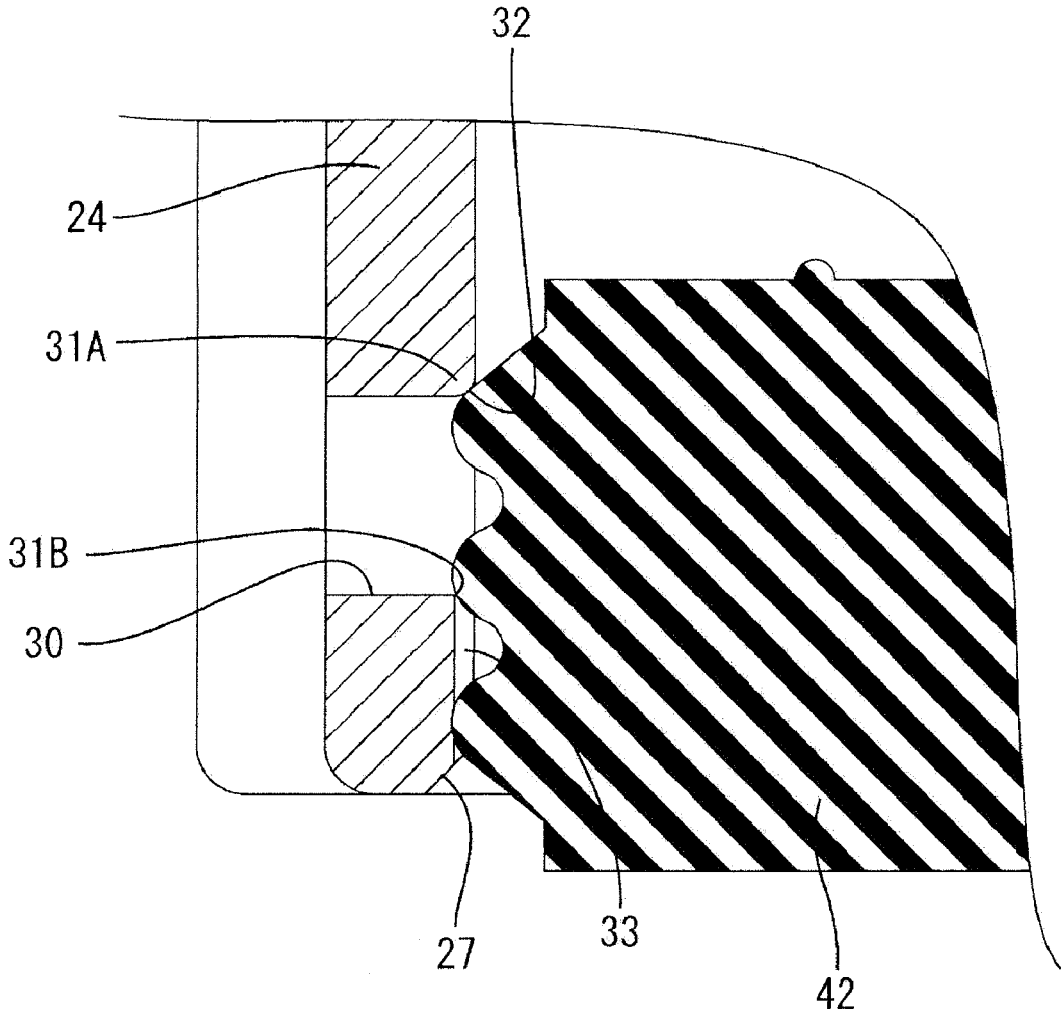
FIG. 7 is an enlarged view of the engaging recess of FIG. 5.

Terminal fittings 40 that have been crimped to the wires 41 are inserted into the cavities 22 and are engage the respective locking lances 23 (see FIG. 4). The rubber plugs 42 mounted on the wires 41 beforehand are guided along the guide grooves 33 and inserted beyond the bevels 32 (see FIG. 5). The cavity-side opening edges 31A of the engaging recesses 30 include the bevels 32. Thus, the rubber plugs 42 can be fit without being damaged. Further, the back retainer 50 is mounted on the wires 41 and is fit into the housing 21 from behind following the rubber plugs 42 so that the engaging projections 54 engage the engaging recesses 30 to fix to the back retainer 50 to the housing 21.

The cavity-side opening edge 31A of the wire insertion tube 24 includes the bevel 32, the rubber plug 42 can be fit properly into the housing 21 without being damaged. Thus, the rubber plugs 42 are not damaged upon assembling the waterproof connector 20. Further, the other opening edges 31 of the engaging recesses 30 are substantially right-angled. Thus, the retaining force of the back retainer 50 is good and spaces between the rubber plugs 42 and the cavities 22 are sealed completely.

The invention is not limited to the above described and illustrated embodiment. For example, the following embodiments are also included in the technical scope of the present invention.

Only the cavity-side opening edges 31A of the engaging recesses 30 have the bevels 32 in the above embodiment. However, the other opening edges 31 that intersect the longitudinal direction LD of the wire insertion tube 24 may also be beveled.

The guide groove 33 is formed between the rear opening edge 31B of the engaging recess 30 and the opening edge 27 of the wire insertion tube 24 in the above embodiment. However, the bevel 32 may be formed without forming the guide groove 33.

The invention has been described with reference to a rubber plug 42. However, the invention is applicable to a resilient plug made of any resilient material other than (natural or synthetic) rubber.

What is claimed is:

1. A fluidproof connector, comprising:

a housing formed with opposite front and rear ends and at least one cavity extending between the ends for accommodating at least one terminal fitting;

a wire insertion tube integral or unitary to the rear end of the housing and through which at least one wire connected with the terminal fitting is inserted, the wire insertion tube having a rear end rearward of the housing and at least one engaging recess formed in an inner circumferential surface of the wire insertion tube at a position forward of the rear end of the wire insertion tube, at least one guide groove formed in the inner circumferential surface of the wire insertion tube and extending from the rear end of the wire insertion tube to the engaging recess;

at least one resilient plug mounted on the wire and having an outer cross-sectional dimension greater than an inner cross-sectional dimension of the wire insertion tube at locations forward of the engaging recess and at least as great as cross-sectional dimension of the wire insertion tube at the guide groove, so that the resilient plug achieves fluid-tight sealing between an outer circumferential surface of the wire and an inner circumferential surface of the wire insertion tube;

a plug retainer mounted into the wire insertion tube at a side of the resilient plug substantially opposite to the cavity, at least one engaging projection projecting from the outer circumferential surface of the plug retainer and engaging the engaging recess; and the engaging recess having at least one opening edge extending in a direction intersecting a longitudinal direction of the wire insertion tube, the opening edge of the engaging recess being formed with a rounded edge at the inner circumferential surface of the wire insertion tube, the rounded edge guiding the resilient plug forward in the wire insertion tube beyond the engaging recess without damaging the resilient plug.

2. The fluidproof connector of claim 1, wherein the engaging recess is a substantially rectangular hole penetrating the wire insertion tube, the rectangular hole having first and second opposed opening edges orthogonal to the longitudinal direction of the wire insertion tube.

3. The fluidproof connector of claim 2, wherein the first opening edge is between the cavity and the second opening edge, the rounded edge being on the first opening edge, the second opening edge defining a right angle to the longitudinal direction of the wire insertion tube.

4. The fluidproof connector of claim 1, wherein the rounded edge is in the form of a cylindrically generated surface.

5. The fluidproof connector of claim 1, wherein the opening edge having the rounded edge is at an end of the engaging recesses closest to the cavity.

6. The fluidproof connector of claim 1, wherein the plug retainer has first legs divided in a width direction and coupled by at least one hinge, the legs being rotatable about the hinge.

7. The fluidproof connector of claim 6, wherein the first and second legs are formed respectively with at least first and second recesses, and the at least one wire being held between the first and second recesses with the both legs closed.

8. The fluidproof connector of claim 6, wherein the at least one engaging projection comprises at least one engaging projection on each of the legs and the at least one engaging recess comprises at least two engaging recesses, the engaging projections being engaged with respectively with the engaging recesses to fix the plug retainer to the housing.

* * * * *